US007591660B1

(12) United States Patent
Eichhorst

(10) Patent No.: US 7,591,660 B1
(45) Date of Patent: Sep. 22, 2009

(54) BI-DIRECTIONAL LUG CONNECTION AND METHOD

(75) Inventor: Stefan Eichhorst, West Bloomfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/061,681

(22) Filed: Apr. 3, 2008

(51) Int. Cl.
*H01R 4/60* (2006.01)

(52) U.S. Cl. ..... 439/212; 439/721; 439/907

(58) Field of Classification Search ..... 439/721, 439/907, 212, 213
See application file for complete search history.

(56) References Cited

U.S. PATENT DOCUMENTS 3,407,382 A * 10/1968 Haegert ..... 439/907
5,196,987 A * 3/1993 Webber et al. ..... 439/212
6,066,006 A * 5/2000 Shaw ..... 439/212

* cited by examiner

*Primary Examiner*—Tho D Ta
(74) *Attorney, Agent, or Firm*—Quinn Law Group, PLLC

(57) ABSTRACT

The present invention is directed to an apparatus and method for connecting a unitary cable terminal plate assembly to a busbar from multiple directions in tight closed spaces so that space and assembly problems are improved. A lug connection is accomplished by combining a polyhedron nut having differently oriented nut holes for cooperation with bi-directional holes in the terminal plate assembly together with a stair-step frame to orient the nut in the terminal plate assembly. This bi-directional connection made with a nut, terminal plate, and frame ensures that no change has to be made to a vehicle component needing an electrical lug connection. Further this invention allows for a preferred tool drive direction, for example only vertically, even though the unitary assembly is being repositioned for better packaging orientation.

11 Claims, 3 Drawing Sheets

BI-DIRECTIONAL LUG CONNECTION AND METHOD

TECHNICAL FIELD

This invention relates to electrical connection systems configured to enable engagement of electrical terminals from multiple directions.

BACKGROUND

In electrical systems, there is commonly the need to join electrically conductive materials to deliver power to components. One type of connection is by cable fasteners known as screw terminals or lug connections. In high current electrical connections this is usually made by and called a lug connection. These screw terminals or lug connections join the cables, generally running from a power supply, such as a car battery or alternator, to other units or components to provide those components or units of the vehicle with power. When a high current cable is connected to such a unit within a vehicle, where the unit is being installed in different orientations throughout different vehicles, the direction of the lug fasteners will change with the orientation of the unit. This will cause the installation of the lug nut fastener to be oriented horizontal in one case and vertical in another case.

Many times assembly of vehicles is difficult because of the tight spaces required to access a connection from one of the two orientations or directions. Further, each such connection needs to be specifically designed for the particular installation or access while taking into account factors such as engineering, cost, and the production line assembly steps and robotics.

SUMMARY

The present invention is directed to an apparatus that satisfies the space and assembly problems described above by allowing cables to connect to a busbar system from multiple directions. The connection is accomplished by the help of a polyhedron nut or fastener which is characterized by outer surfaces. The polyhedron nut has a number of threaded nut holes in it. Further assisting is a special terminal plate. The terminal plate is electrically conductive and has at least a first terminal plate hole. The holes of the terminal plate and the nut are aligned with each other such that the bolts or fasteners that hold the components together can be tightened from multiple directions or from a single direction even if the whole assembly that contains the apparatus is rotated up to 90 degrees on either of two of its three axes. Further assisting is a unique frame which holds multiple nuts and terminal plates in the positions to allow them all to be accessed from a selected direction.

This bi-directional connection made with the nuts, plates, frame, and other components aids in reducing manufacturing costs since only one device needs to be produced. That single device can be used where a number of specifically designed devices had to be used before. Further, even if a unit is being rotated for better packaging orientation, no change has to be made to a unit that needs an electrical lug connection made by a threaded fastener so that assembly can occur from a preferred tool drive direction.

More particularly, one feature of this lug connection invention is an apparatus for joining a cable to a busbar. The apparatus comprises a first polyhedron nut, which is characterized by outer surfaces, defining a plurality of threaded or fastener holes having respective openings in the outer surfaces; and a first terminal plate, which is electrically conductive, and is characterized by differently oriented portions having outer and inner surfaces, and defining respective terminal plate holes; wherein each threaded or fastener hole is coaxially aligned with a respective terminal plate hole.

Also provided herein is a method of bi-directionally connecting a busbar to a non-axially aligned cable assembly, each having, respective, non-axially aligned electrical connectors. The method comprises configuring a first electrical connector on the busbar cable assembly to match with a respective second electrical connector on the busbar cable assembly from two non-axially aligned directions; configuring, a second electrical connector on the busbar cable assembly to match the configuration of the first electrical connector in both of the two non-axially aligned directions; and selectively fastening the first electrical connector to the second electrical connector from one of said two non-axially aligned directions, whereby to electrically connect the busbar to the non-axially aligned cable assembly in a selected one of the two non-axially aligned directions.

And yet another feature of the invention is a method of assembling electrical terminal plates for engagement in multiple directions. The method comprises providing a first and second polyhedron nut. Each nut defines an even and an odd nut hole, and, for each nut hole, providing a first and second bolt fastener. The method also provides first, second, third, and fourth terminal plates, that define respective first, second, third, and fourth terminal plate holes. A frame is provided. The first terminal plate is attached to the frame. The second terminal plate is attached to the frame so that the axis of the second terminal plate hole is substantially perpendicular to the axis of the first terminal plate hole. The third terminal plate is attached to the frame so that the axis of the third terminal plate hole is substantially parallel to the axis of the first terminal plate hole. The fourth terminal plate is attached to the frame so that the axis of the fourth terminal plate hole is substantially perpendicular to the axis of the first terminal plate hole. The method then comprises placing the first polyhedron nut such that the odd nut hole is coaxially aligned with the first terminal plate hole and the even nut hole is coaxially aligned with the second terminal plate hole; and placing the second polyhedron nut such that the odd nut hole is coaxially aligned with the third terminal plate hole and the even nut hole is coaxially aligned with the fourth terminal plate hole. Then the method comprises choosing one of said multiple directions from which to engage said terminal plates and rotating the frame sufficiently to move the axis of one of said even nut holes and said odd nut holes to face in the chosen direction; then aligning the first and second fasteners with a respective one of said even nut holes and said odd nut holes that is facing in the chosen direction; and then engaging the electrical terminal plates with said bolt or fastener from said chosen direction into one of said even nut holes and said odd nut holes.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1A:
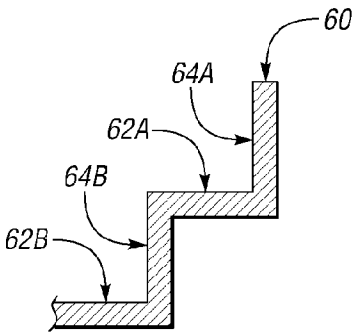
FIG. 1*a* is a fragmentary or partially cut-away cross-sectional profile view of a stair-step frame having surfaces defining first and second nut locations for supporting and locating a nut with a selective terminal plate.
Figure 1B:
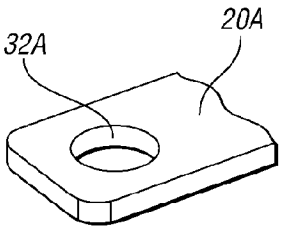
FIG. 1*b* is a fragmentary or partially cut-away perspective view of a terminal plate.
Figure 1C:
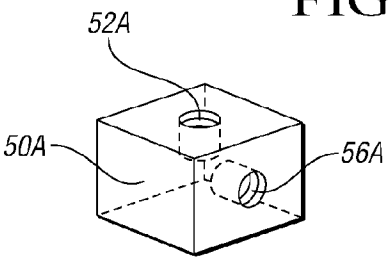
FIG. 1*c* is a perspective view of the polyhedron nut.
Figure 1:
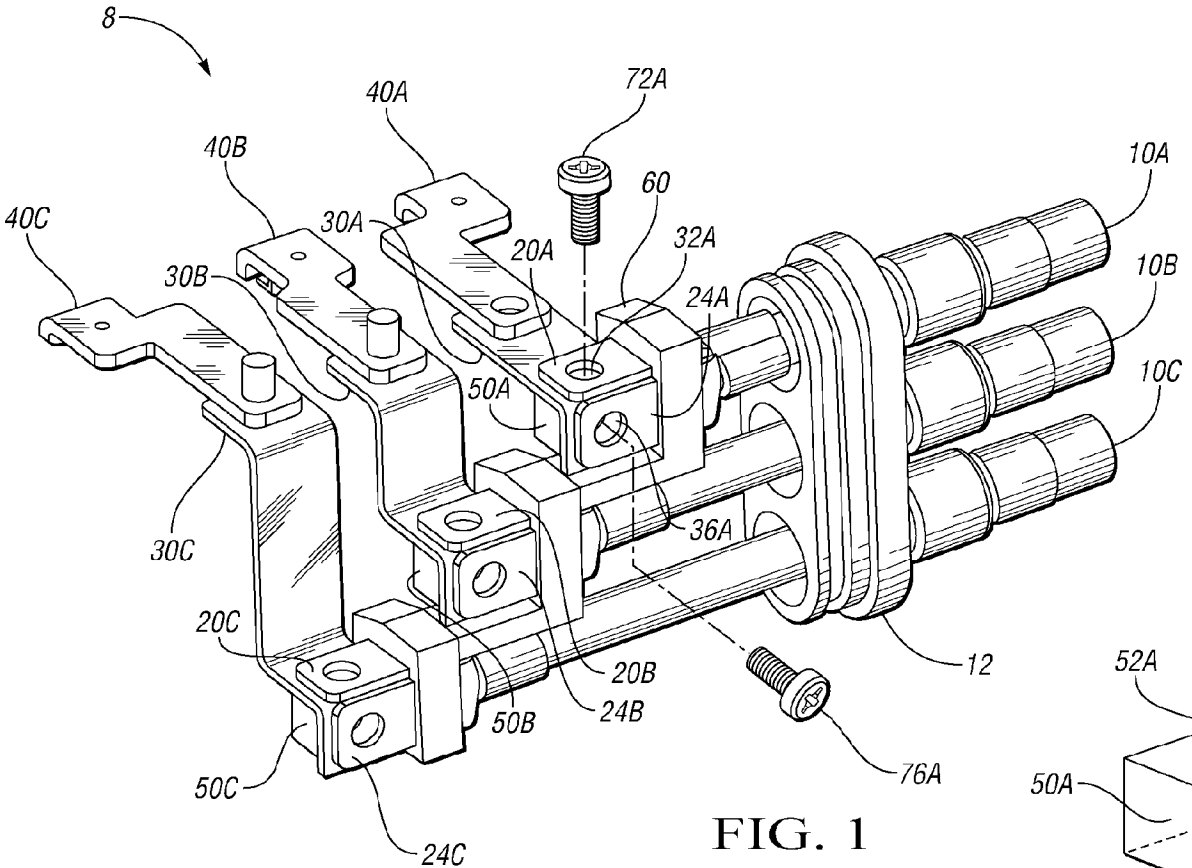
FIG. 1 is an isometric or perspective view of the top and left side of the bi-directional lug connection of this invention for connecting a busbar system to a cable assembly with a selective terminal plate's busbar joining member and polyhedron nut.

FIG. 1 shows a lug connection 8 wherein three cables 10A, 10B, and 10C, are electrically connectable to corresponding busbars 40A, 40B, and 40C. There are three polyhedron nuts 50A, 50B, and 50C. The relationship between the nuts and the other components will be described for the "A" group and is substantially similar for the "B" and "C" groups.

Figure 3:
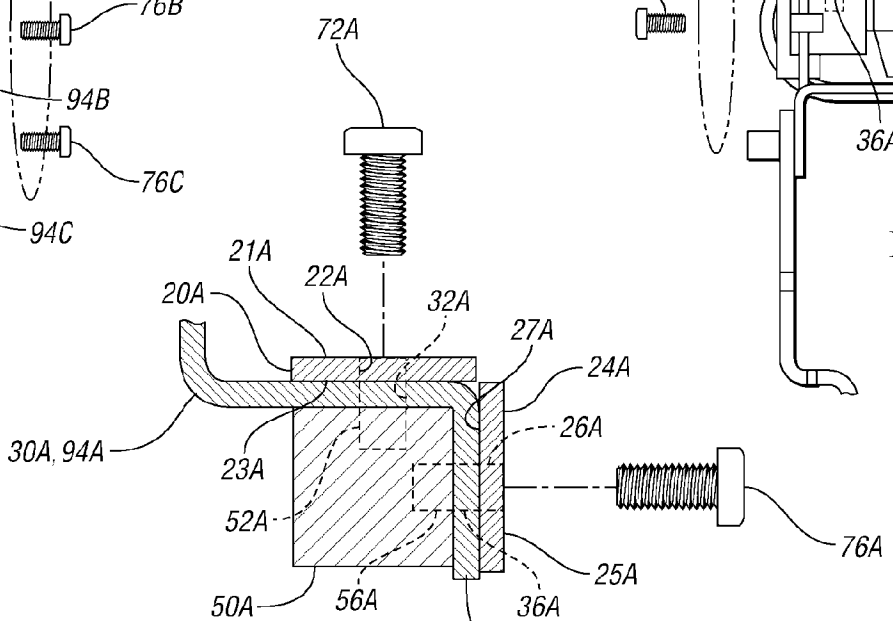
FIG. 3 is a fragmentary cross-sectional front view detail of the nut holes in a representative polyhedron nut and its adjacently connected joining member and terminal plates as a representative portion of the lug connection.

With reference to FIG. 1, FIG. 1*c*, and FIG. 3, exemplary nut 50A has adjacent outer surfaces with two respective nut holes in it at 52A and 56A. These holes 52A, 56A are positioned to allow a fastening device such as bolts 72A, 76A to connect into a selected one hole 52A without blocking the other hole 56A or vice versa.

With reference to FIG. 1, FIG. 1*b*, and FIG. 3, exemplary nut 50A has two exemplary terminal plates 20A, 24A associated with it. (The other terminal plates 20B, 24B, 20C, 24C are similarly configured.) Each terminal plate such as 20A, 24A is electrically conductive, for example made from a material such as metal, and is physically and electrically connected respectively to an end of the cables 10A, 10B, 10C for example by being crimped onto the end of the cable wire to protect it, whereby to become electrically conductive portions of the cable.

With reference to FIG. 3, the first terminal plate 20A has an outer facing surface 21A, inner facing surface 23A, and a terminal plate hole 22A. The second terminal plate 24A has an outer facing surface 25A, inner facing surface 27A, and a terminal plate hole 26A. The first terminal plate hole 22A is positioned in alignment with one of the nut holes 52A. The second terminal plate hole 26A is positioned in alignment with the other of the nut holes 56A.

With reference to FIGS. 1 and 3, also paired with the nut 50A is a busbar joining member 30A. The busbar joining member 30A is electrically conductive. With reference to FIG. 3, when assembled, the busbar joining member 30A adjoins, touches, or matches the terminal plates 20A, 24A along their inner surfaces 23A, 27A to allow current to flow there between. The busbar joining member 30A has two holes in it at 32A and 36A. The first busbar hole 32A is aligned with the first terminal plate hole 22A and the first nut hole 52A. The second busbar hole 36A is aligned with the second terminal plate hole 26A and the second nut hole 56A. With reference to FIG. 1, the exact physical form of the busbar joining members 30A, 30B, 30C vary depending on their position or orientation and the distance needed to span between each busbar 40A, 40B, 40C in its respective terminal plate portion of the respective cable 10A, 10B, 10C. Likewise the relative lengths of the sections of each busbar joining member will also vary in length.

With reference again to FIGS. 1 and 3, a stair-step frame 60 holds the first group A of terminal plates 20A, and 24A; the second group B of terminal plates 20B, and 24B; and the third group C of terminal plates 20C, and 24C. The stair-step frame 60 holds group A, such that the corresponding group A holes 22A, 32A, and 52A; and 26A, 36A, and 56A; are all unblocked and aligned and so that bolts 72A, 76A, can all be inserted from a desired direction. Likewise, the stair-step frame 60 similarly holds group B terminal plates 20B and 24B and group C terminal places 20C and 24C so that the corresponding holes in their respective terminal plates will also align with like holes in their respective nuts 50B and 50C so that other bolts like 72A and 76A can likewise be inserted from a desired direction. The cable guide 12, of the cable assembly, spaces the cables 10A, 10B, and 10C apart and adds additional support as they approach and attach to the stair-step frame 60. Referring to FIG. 1*a*, the frame 60 also is formed with two surfaces: tread surfaces 62A, 62B, and riser surfaces 64A, 64B.

Figure 2B:
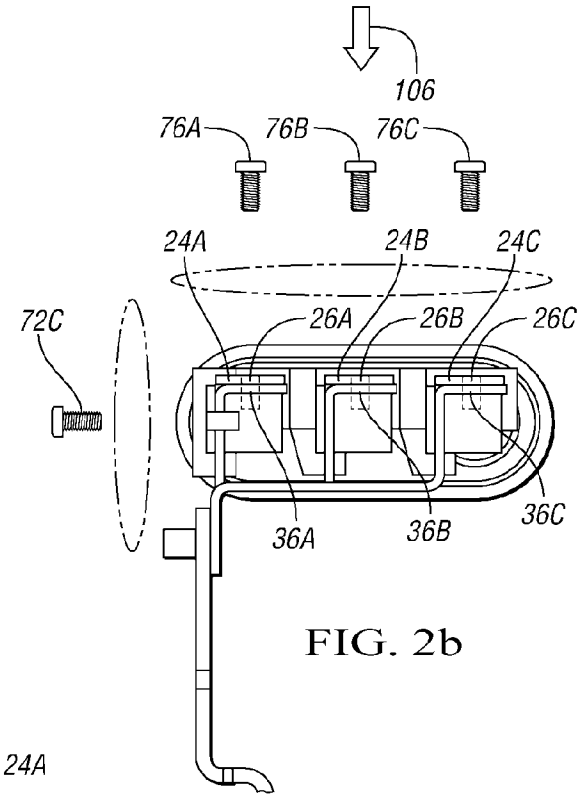
FIGS. 2*a* and 2*b* are partly exploded front views of the lug connection along a Z axis showing each of the busbar joining members at each of the two orientations, and their selective respective openings for attaching a busbar joining member to a complementary terminal plate and nut, with phantom circular arcs suggesting the orientation of bolts for selectively connecting joining member, terminal plate and polyhedron nut.
Figure 2A:
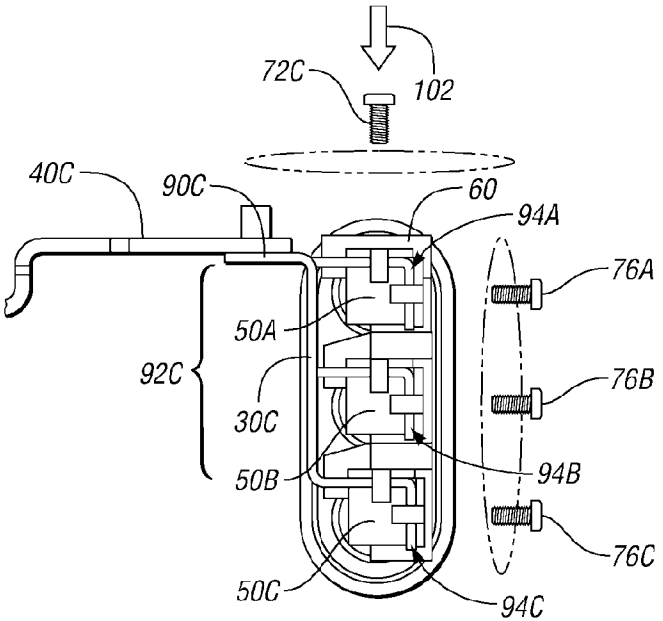

With reference to FIGS. 2*a* and 2*b*, the busbar 40C, is connected to the busbar joining member 30C at the first of its three component sections a first joining end 90C. The other two sections are a middle section 92C and a second joining end 94C. Likewise busbars 40B and 40A (shown in FIG. 1) are connected to busbar joining members 30B and 30A (shown in FIG. 1) respectively and have corresponding sections extending their respective joining ends toward the stair step frame 60. However, because of the front view in FIGS. 2*a* and 2*b*, only sections 94A (of busbar joining member 30A) and 94B (of busbar joining member 30B) are visible while all of joining member 30C including its end 94C is visible. The first joining end 90C is substantially similar for all of joining members 30A, 30B, and 30C in that these joining ends are configured to mate with their respective busbar 40C, 40B, and 40A (shown in FIG. 1). The exact length of the middle sections such as 92C, varies depending on which group (A, B, or C) is connecting to the stair-step frame 60. The second joining end 94C, 94B, 94A contains a bend in the metal, in this case approximately 90 degrees, which can vary in the embodiment depending on the hole locations in the polyhedron nut 50C, 50B, 50A. In sum, each joining member is divided into different sections—two joining ends and a middle section. With reference to FIGS. 2*a* and 2*b*, again, everything is aligned on the stair-step frame 60 to allow a respective bolts 72A and 76A in FIGS. 1 and 3 and respective bolts, 72C and 76A, 76B, and 76C access to a respective nut hole from either of two directions 102 or 106.

FIG. 3 shows an enlarged cross-sectional front view of the area around a representative single nut 50A and complementary terminal plate portions 20A and 24A. FIG. 1*c* also shows a perspective view of the nut 50A with nut holes 52A and 56A. The other nut and terminal plate lug connections are substantially similar. Referring back to FIG. 3, nut 50A, for instance, on one side defines a nut hole 52A. Adjacent the nut hole 52A is the bottom section 94A of the busbar joining member 30A. The final or bottom connection end 94A defines the hole 32A. Adjacent hole 32A is the terminal plate 20A which defines the hole 22A. The holes 22A, 32A, and 52A are all aligned to allow a bolt 72A to be screwed or fastened into the nut through the aligned holes. Another surface of the nut 50A is located on the side which defines another nut hole 56A. Adjacent the nut 50A is another section of the busbar joining member 30A in particular, the final connection end 94A, which defines another hole 36A. Adjacent the busbar joining member 30A is the terminal plate 24A which defines the hole 26A. The holes 26A, 36A, and 56A are all aligned to allow a bolt 76A to be screwed or fastened into the nut through the aligned holes.

Figure 4B:
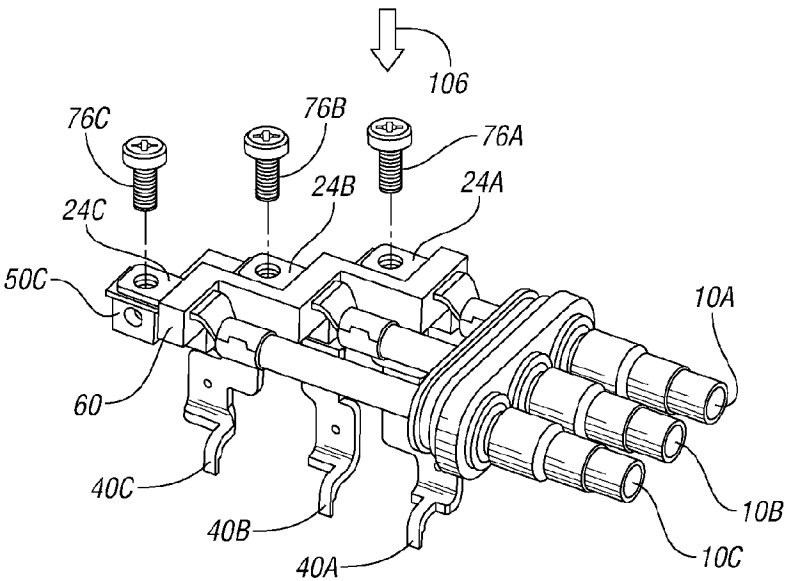
FIGS. 4*a* and 4*b* are perspective views of two orientations of a unitary busbar and cable assembly illustrating vertical access for making a selected lug connection by repositioning the assembly so as to accommodate a desired fastening direction.
Figure 4A:
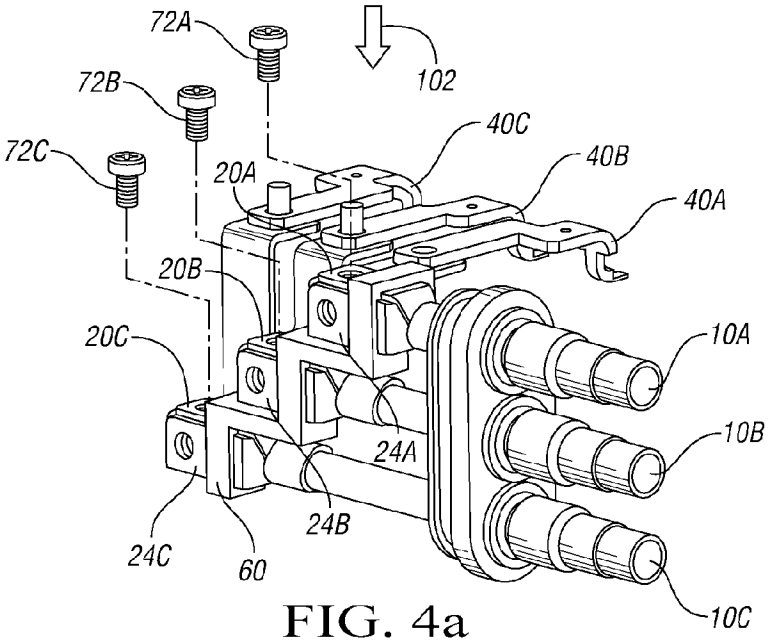

FIGS. 4*a* and 4*b* show two orientations of the unitary busbar and cable assembly with respect to a vehicle component 120 (FIG. 5) so that a vertical lug connection of the unit can be made in the direction of choice due to the two different orientations 102 or 106. The unit may have its orientation changed rotating approximately 90 degrees, based on the packaging requirements of the unit housing 110 (shown in FIG. 5).

With reference to FIG. 4*b*, more particularly, in orientation 106, the bolts 76A, 76B, and 76C (y-axis plane) are inserted though their corresponding holes in the terminal plates 24A, 24B, and 24C. As was shown and described in detail for group A in FIG. 3 and is repeated here, the bolts pass via the terminal plate holes 26A (see FIGS. 2*b* and 3), 26B, and 26C and through the respective busbar joining members 30A, 30B, and 30C (see FIG. 1) via a respective one of busbar joining member holes 36A (see FIGS. 2*b* and 3), and like holes in joining members 30C and 30B, and screwed or fastened into the nuts 50A, 50B, and 50C via the holes such as 52A, (y-axis plane) in the nuts 50A, 50B, and 50C (see FIGS. 1, 2*a*, and 3).

More particularly, in orientation 102 (FIGS. 4*a* and 2*a*), the bolts 72A, 72B, and 72C (x-axis plane) are inserted though their corresponding holes in the terminal plate 20A, 20B, and 20C. As was shown and described in detail for group A in FIG. 3 and is now described here in further detail the bolts pass via the terminal plate holes such as 22A (see FIG. 3), in terminal plates 20A, 20B, and 20C, (x-axis plane) and through holes such as 32A (see FIG. 3 in the busbar joining members 30A, 30B and, 30C (see FIG. 1) and screwed or fastened respectively into the nuts 50A, 50B, and 50C (see FIG. 1) via the respective holes such as 52A (see FIG. 3), (x-axis plane) in respective nuts 50A, 50B, and 50C.

Figure 5:
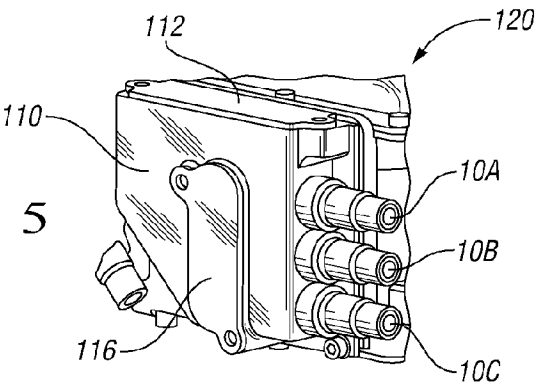
FIG. 5 is a perspective view of an orientable unit housing for a vehicle component, which provides different openings for making the lug connection from a fastening direction of choice.

FIG. 5 shows the unit packaging or housing 110 with two differently oriented access doors 112 and 116 and with the three cables 10A, 10B, and 10C of the unit assembly extending out the side. Depending on the orientation of the unit housing 110 with respect to the other vehicle components to which the unit is being assembled, the lug connection is made through either access door 112 or access door 116.

The previously described versions of the present invention have many advantages, including being able to assemble from multiple directions, decreased costs associated with reusable parts. But the invention does not require that all the advantageous features and all the advantages need to be incorporated into every embodiment of the invention.

With reference across FIGS. 1, 4*a*, 4*b*, 2*a*, and 2*b*, starting with FIG. 1, this invention also embodies a method of bi-directionally connecting a busbar 40A, 40B, 40C (see FIG. 1) to a respective cable assembly 10A, 10B, 10C (see FIG. 1) each having respective non-axially aligned electrical connectors 20A, 20B, 20C (see FIG. 1) or 24A, 24B, 24C (see FIG. 1), and 30A, 30B, 30C (see FIG. 1). The method includes configuring a first electrical connector 30A, 30B, 30C (see FIG. 1) on the respective busbar 40A, 40B, 40C (see FIG. 1) to match with a respective second electrical connector 20A, 20B, 20C (see FIG. 1) or 24A, 24B, 24C (see FIG. 1) connected to the respective cable (see FIG. 1) from two non-axially aligned directions 102 and 106 (see FIGS. 2*a* and 2*b*) such that the respective bolts 72A, 72B, 72C (see FIG. 4*b*) are insertable or fastenable from the x-axis plane 102 or the respective bolts 76A, 76B, 76C (see FIG. 4*b*) are insertable or fastenable from the y-axis plane 106. The method also comprises configuring the second electrical connector 20A, 20B, 20C (see FIG. 1) or 24A, 24B, 24C (see FIG. 1) to match the configuration of the first electrical connector 30A, 30B, 30C (see FIG. 1) in both of the two non-axially aligned directions; and then selectively fastening the first electrical connector 30A, 30B, 30C (see FIG. 1) to the second electrical connector 20A, 20B, 20C (see FIG. 1) or 24A, 24B, 24C (see FIG. 1) as by the respective bolts 72A, 72B, 72C (see FIG. 4*b*) or 76A, 76B, 76C (see FIG. 4*a*) from one of the two non-axially aligned directions, whereby to electrically connect the busbar 40A, 40B, 40C (see FIG. 1) to the non-axially aligned cable assembly in a selected one of two nonaligned directions, such as vertical 102 (shown in FIG. 2*a* and FIG. 4*a*) or horizontal 106 (shown in FIG. 2*b* and FIG. 4*b*).

With reference to FIG. 1 and FIG. 3, this invention also includes a method of assembling electrical terminal plates for engagement in multiple non-axially aligned directions wherein, a first electrical connector, or terminal plates 20A, 20B, 20C, 24A, 24B, 24C, and a second electrical connector, or a busbar joining members 30A, 30B, 30C, are configured to align the components as described for group A (shown in FIG. 3) and likewise applicable simultaneously to group B and C as follows: the non-aligned terminal plate holes such as 22A and 26A, with the respective busbar joining member holes such as 32A, and 36A. Once configured and hence aligned, the axis of these holes will be different and a fastening device, such as a bolt 72A, may be inserted in either the vertical direction 102 or a fastening device such as a bolt 76A may be inserted in the horizontal direction 106 to complete the electrical connection.

Although the present invention has been described in considerable detail with reference to certain preferred versions thereof, other versions are possible. Therefore, the spirit and scope of the appended claims should not be limited to the description of the preferred versions contained herein.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

While the best modes for carrying out the invention have been described in detail, those familiar with the art to which this invention relates will recognize various alternative designs and embodiments for practicing the invention within the scope of the appended claims.

The invention claimed is:

1. An apparatus for joining a cable to a busbar, comprising:

a. a first polyhedron nut, characterized by outer surfaces, and defining a plurality of threaded or fastener nut holes, each hole defining a respective central axis, and having respective openings in the outer surfaces of the nut;

b. a first terminal plate, which is electrically conductive, and characterized by an outer and inner surface, and defining at least a first terminal plate hole and a second terminal plate hole, each hole defining a respective central axis; wherein each threaded or fastener nut hole is coaxially aligned with a respective terminal plate hole;

c. a busbar joining member, characterized by a first joining end, a middle section, and a second joining end;

d. the busbar joining member first joining end defining at least one busbar first joining end hole;

e. the busbar first joining end hole, being coaxially aligned with one of the terminal plate holes and one of said threaded or fastener nut holes;

f. the busbar joining member first joining end being positioned between the threaded or fastener nut outer surface and the terminal plate inner surface; and g. the busbar joining member being in electrical communication with the first terminal plate.

2. The apparatus of claim 1, wherein the nut is cubic and defines said nut holes in adjoining surfaces of said nut.

3. The apparatus of claim 1, wherein said first terminal plate is characterized by differently oriented terminal plate portions, each terminal plate portion defining one of said terminal plate holes.

4. An apparatus, for joining a cable to a busbar, comprising:

a. a first polyhedron nut, characterized by outer surfaces, and defining a plurality of threaded or fastener nut holes, each hole defining a respective central axis, and having respective openings in the outer surfaces of the nut;

b. a first terminal plate, which is electrically conductive, and characterized by an outer and inner surface, and defining at least a first terminal plate hole and a second terminal plate hole, each hole defining a respective central axis; wherein each threaded or fastener nut hole is coaxially aligned with a respective terminal plate hole;

c. a frame;

d. a second polyhedron nut, characterized substantially like said first polyhedron nut is characterized;

e. a second terminal plate, characterized substantially like said first terminal plate is characterized, and defining a third and fourth terminal plate hole;

f. the frame configured to align the first, second, third, and fourth terminal plate holes so that the terminal plate holes are not obstructed by the said frame;

g. the frame configured to align the axes of said first and third terminal plate holes substantially parallel to each other;

h. the frame configured to align the axes of said second and fourth terminal plate holes substantially parallel to each other; and i. the frame configured to substantially not align the axes of said first and second terminal plates holes and the axes of said third and fourth terminal plate holes.

5. The apparatus of claim 4, wherein:

a. the frame is an electrically insulative plate, having a stair-step like shape, characterized by first tread and second tread surfaces and first riser and second riser surfaces;

b. the first riser surface and second riser surface being substantially parallel to each other;

c. the first tread surface and second tread surface being substantially parallel to each other; and d. the first and second tread surfaces being substantially perpendicular respectively to the first and second riser surfaces.

6. The apparatus of claim 4 including at least two bolts or fasteners, the frame configured to position each nut and bolt or fastener, wherein a respective bolt or fastener is fastened though a respective terminal plate hole, into a respective threaded or fastener nut hole to join the bolt or fastener, terminal plate, and nut, all together from a single direction oriented with respect to an outer surface of a respective terminal plate.

7. A method of bi-directionally connecting a busbar to a cable assembly each having respective non-axially aligned electrical connectors comprising:

a. configuring a first electrical connector on the cable assembly to match with a respective second electrical connector connected to the busbar from two non-aligned directions;

b. configuring said second electrical connector to match the configuration of said first electrical connector in both of the two non-axially aligned directions; and c. selectively fastening the first electrical connector to the second electrical connector from one of said two non-axially aligned directions, whereby to electrically connect the busbar to the non-axially aligned cable assembly in a selected one of two nonaligned directions.

8. The method of claim 7, wherein said configuring said first electrical connector comprises configuring a terminal plate connected to a cable.

9. The method of claim 7, wherein said configuring said second electrical connector comprises configuring a joining member connected to said busbar.

10. A method of assembling an electrical terminal plate for engagement in multiple directions, the method comprising:

a. providing a first and second polyhedron nut, each characterized as defining an even and odd nut hole;

b. providing a first and second bolt or fastener;

c. providing first, second, third, and fourth terminal plates, each defining a respective first, second, third, and fourth terminal plate hole, each hole having a central axis;

d. providing a frame;

e. attaching the first terminal plate to the frame;

f. attaching the second terminal plate to the frame so that the axis of the second terminal plate hole is substantially perpendicular to the axis of the first terminal plate hole;

g. attaching the third terminal plate to the frame so that the axis of the third terminal plate hole is substantially parallel to the axis of the first terminal plate hole;

h. attaching the fourth terminal plate to the frame so that the axis of the fourth terminal plate hole is substantially perpendicular to the axis of the first terminal plate hole;

i. placing the first polyhedron nut such that its odd nut hole is coaxially aligned with the first terminal plate hole and its even nut hole is coaxially aligned with the second terminal plate hole;

j. placing the second polyhedron nut such that its odd nut hole is coaxially aligned with the third terminal plate hole and its even nut hole is coaxially aligned with the fourth terminal plate hole;

k. choosing one of said multiple directions from which to engage said terminal plates;

l. positioning the frame sufficiently to move the axis of one of said even nut holes and said odd nut holes to face in the chosen direction;

m. aligning the first and second bolts or fasteners with a respective one of said even nut holes and said odd nut holes facing in the chosen direction; and n. engaging the electrical terminal plates with said bolt or fastener from said chosen direction into one of said even nut holes and said odd nut holes.

11. A method of assembling an electrical terminal plate for engagement in multiple directions, the method comprising:

a. providing a first and second polyhedron nut, each characterized as defining an even and odd nut hole;

b. providing first, second, third, and fourth terminal plates, each defining a respective first, second, third, and fourth terminal plate hole, each hole having a central axis;

c. placing the first polyhedron nut such that its odd nut hole is coaxially aligned with the first terminal plate hole and its even nut hole is coaxially aligned with the second terminal plate hole to provide for engagement in one direction;

d. placing the second polyhedron nut such that its odd nut hole is coaxially aligned with the third terminal plate hole and its even nut hole is coaxially aligned with the fourth terminal plate hole to provide for engagement in another direction;

e. whereby to provide for engagement of the electrical terminal plates from a chosen direction into one of said even nut holes and said odd nut holes.

* * * * *